US005419734A

United States Patent [19]

Van Sickle

[11] Patent Number: 5,419,734

[45] Date of Patent: May 30, 1995

[54] SANDBLASTING HOSE HOLDER FOR TREATING UPRIGHT SURFACES

[76] Inventor: Jimmy L. Van Sickle, 7750 SE. Johnson Creek Blvd., Portland, Oreg. 97206

[21] Appl. No.: 82,383

[22] Filed: Jun. 28, 1993

[51] Int. Cl.[6] ..... B24C 3/06

[52] U.S. Cl. ..... 451/90; 239/587.1; 239/587.5; 451/92; 451/102

[58] Field of Search ..... 51/410, 427; 239/282, 239/283, 450, 548, 587.1, 587.2, 587.5, 587.6

[56] References Cited

U.S. PATENT DOCUMENTS

| | | | |
|---|---|---|---|
| 973,810 | 10/1910 | Regan | 239/587.1 X |
| 1,887,395 | 11/1932 | Billings et al. . | |
| 1,974,470 | 9/1934 | Ruemelin, Jr. | 51/8 |
| 2,063,054 | 12/1936 | Rosenberger | 51/8 |
| 2,701,408 | 2/1955 | Borger | 29/90 |
| 2,836,013 | 5/1958 | Koenig | 51/427 |
| 2,953,876 | 9/1960 | Zieber et al. | 51/8 |
| 3,391,494 | 7/1968 | Dye, Jr. | 51/8 |
| 3,436,866 | 4/1969 | Nye | 51/8 |
| 4,027,433 | 6/1977 | Hockett | 51/410 |
| 4,139,970 | 2/1979 | Hockett | 51/427 |
| 4,309,850 | 1/1982 | Benson | 51/429 |
| 4,561,220 | 12/1985 | Carpenter et al. | 51/427 |
| 5,007,585 | 4/1991 | Kubacak et al. | 239/587.1 X |

FOREIGN PATENT DOCUMENTS

| | | | |
|---|---|---|---|
| 2525761 | 12/1977 | Germany | 51/410 |

*Primary Examiner*—Joseph M. Gorski
*Attorney, Agent, or Firm*—Eugene M. Eckelman

[57] ABSTRACT

A frame member is capable of connection to a lifting cable moving the frame relative to a surface to be cleaned. The carriage is supported on the frame member and is adjustable on tracks between sides of the frame members. A hose support is pivotally mounted on the frame member on a lateral axis and has an operator's handle for moving the carriage and pivoting the hose support. The hose support includes a clamp for multiple hoses for large area treatment. One or more of the hoses may be individually removed for operation independent of the multiple hose support. An auxiliary clamp for the hoses is provided to free up movement of the carriage. The operator's handle for the carriage has switches thereon for operation of the multiple hoses, at least one of the switches being removable for controlling operation of a single hose that has been removed from the carriage.

4 Claims, 3 Drawing Sheets

SANDBLASTING HOSE HOLDER FOR TREATING UPRIGHT SURFACES

BACKGROUND OF THE INVENTION

This invention relates to new and useful improvements in a sandblasting hose holder.

Sandblasting is often used to remove dirt, loose particles and rust from surface areas. Various apparatuses have been devised that support a sandblasting hose movably for covering areas to be cleaned. Such apparatuses are in the form of stationary frames with carriages that allow vertical and horizontal adjustment of the sandblasting hose. U.S. Pat. Nos. 1,974,470; 2,063,054; 2,953,876, and 3,391,494 are representative of such structures. These stationary apparatuses, while providing efficient hose positioning and control, are not portable to the extent that they can be used to clean elevated areas such as wall surfaces of buildings, tanks, etc. Such type of surface cleaning is presently accomplished by workmen operating a single hose. This process is slow and in addition requires tiring energy on the part of the workman.

Some sandblasting units have been made portable such as shown in U.S. Pat. No. 4,309,850 comprising a unit mounted on a motor vehicle drawn platform for cleaning road surfaces, and U.S. Pat. No. 4,027,433 comprising a sandblasting apparatus arranged to be mounted on a movable platform or chassis such as a lift truck for cleaning a surface by controlling operation of a plurality of nozzles.

None of these former units is capable of being supported by winch lines for use with staging to clean wall surfaces, and in addition no apparatus exists that is compact in structure to the extent that it can be moved through restricted entrance openings of tanks for interior surface cleaning.

SUMMARY OF THE INVENTION

According to the present invention and forming a primary objective thereof, a sandblasting hose holder is provided having improved features that allow it to be suspended from staging for cleaning upright surface areas of buildings, tanks, etc.

Another object of the invention is to provide a sandblasting hose holder that is compact in structure whereby to be of minimum weight and size and capable of movement through access openings in water tanks and the like. The apparatus can also be readily partially disassembled if necessary so that it can be fitted through limited dimension openings.

Other objects are to provide a holder of the type described having a novel hose support that resists the forces of recoil of pressure on the nozzles of the hose so that the operator does not have to expend any particular energy in resisting such forces, that is freely movable to position the hoses for reaching work areas efficiently, that holds a plurality of hoses for treating an enlarged area at the same time, and that allows release of one or more hoses from the holder for cleaning small or hard to get at areas with a single hose.

In carrying out the objects of the invention, a portable frame is provided that is capable of suspension from cables. This frame has laterally extending upper and lower frame members and connecting end frame members. The laterally extending frame members comprise support and guide rails for a laterally movable carriage that holds the nozzle end of a plurality of sandblasting hoses. This carriage has an operator's handle projecting therefrom by means of which the operator can move the carriage laterally relative to a surface to be cleaned and also to move a hose support in the carriage pivotally up and down. Auxiliary support of the sandblast hoses to free up movement of the carriage is provided. This auxiliary support and the support at the carriage provides release of one or more of the hoses for individual use of a single hose if desired. The operator's handle has switch means thereon capable of controlling powered sandblasting means for selected hoses. Selected switch means can be detached from the handle for the use of a hose removed from the holder.

The invention will be better understood and additional objects and advantages will become apparent from the following description taken in connection with the drawings.

DETAILED DESCRIPTION OF A PREFERRED EMBODIMENT

Figure 1:
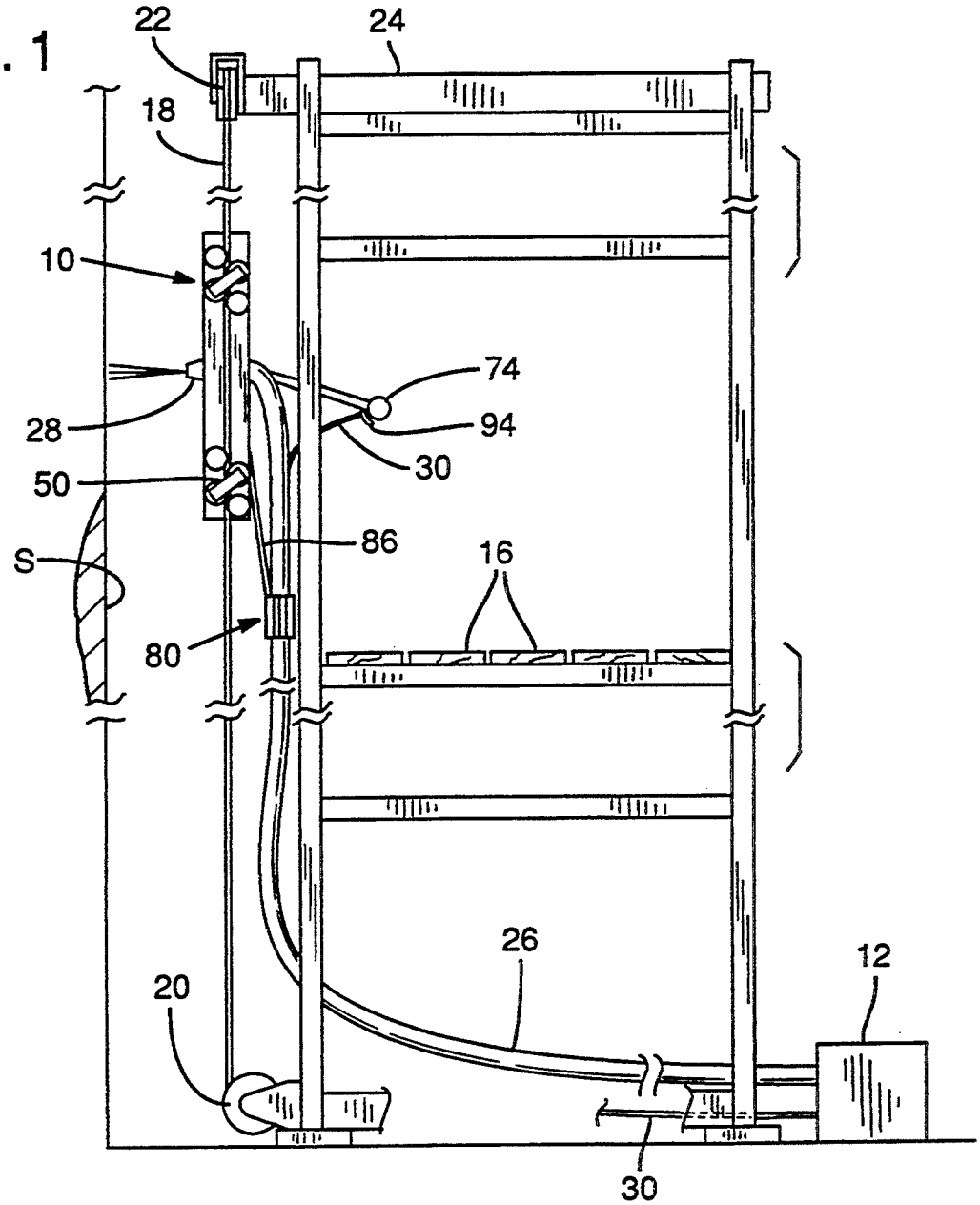
FIG. 1 is a side elevational view of the present invention supported on staging for sandblasting surfaces of a building or tank.

With particular reference to the drawings, the holder of the invention, designated generally by the numeral 10, is used with a remote sandblasting apparatus 12, FIG. 1. The invention finds preferred use with staging 14, also seen in FIG. 1, of knock-down portable structure wherein the operator stands on planks 16 of the staging and manipulates the invention to direct a cleaning force against the surface S to be cleaned. The invention is suspended from cables 18 that lead from a ground supported winch 20 to upper sheaves 22 supported by brackets 24 secured to the staging. The sand blast apparatus 12 includes outlet hoses 26 leading upwardly from a point below the suspended holder. Hoses 26 have nozzles 28 for concentrated discharge of the sandblasting material. Control of the sandblasting apparatus 12 is by electric circuitry 30 leading from electric drive means of the sandblasting unit and including switches 32, FIGS. 5 and 6, available to the operator, as will be more fully described hereinafter.

The holder of the invention provides a suspended holder for the hoses 26 to relieve the strain on the operator and also to employ multiple hoses for increasing the sandblasting efficiency. The holder comprises upper and lower lateral frame members 40 and 42, respectively, secured together at the ends by upright frame members 44. The end frame members 44 are releasably secured to the lateral frame members by bolts 46. Bolts 46 allow the main frame members 40, 42 and 44 to be readily disconnected for ease of transportation and storage and also to disassemble the holder to compact it to a size that permits it to be passed through restricted openings such as openings into tanks. Suspension cables 18 are secured at one of their ends to anchor posts 48 integral with the top frame member 40 of the holder and lead from the anchor posts over the upper sheaves 22 down to the winch 20. The downwardly extending reaches of the cables pass through roller assemblies 50 and are captive therein to steady the holder. The roller assemblies stabilize the frame 10 against lateral swaying movement and also against movement away from the surface being cleaned as a result of outward forces of sandblasting.

A carriage 54 operates within the frame 10, this carriage comprising a rectangular frame portion 56 with top and bottom grooved roller assemblies 58 engageable with top and bottom V-rails 60, such structure providing free rolling lateral movement of the carriage. A hose clamp assembly 64 is supported within the frame portion 56 of the carriage by end spindles 66 which while supporting the clamp assembly 64 in place allow the clamp assembly to pivot on its lateral axis. This clamp assembly includes top and bottom plates **64*a* and 64*b* with resilient lined, mating sockets 68 that frictionally grip the nozzle ends of the hoses. Plates 64*a* and 64*b* are releasably secured together by wing nut fasteners 70 at the ends. Each of the end sockets has an end plate segment 64*c* forming a part of the top plate 64*a* but connected thereto by a hinge 64*d***. This structure allows the end hoses to be released independently of the others.

Pivot positioning of the clamp assembly and lateral movement of the carriage 54 are controlled by the operator by a handle 74 on a pair of rods 76 leading integrally from the clamp assembly. Handle 74 has electric control means thereon, to be described, for controlling power to the sandblasting apparatus 12.

An auxiliary hose clamp assembly 80 is also provided but is independent of the holder 10. This clamp assembly is secured to the multiple hoses 26 in spaced relation from the holder below the handle 74 but capable of ready access to the operator. Clamp assembly 80, similar to clamp assembly 64 on the carriage, has a pair of plates **80*a* and 80*b* releasably secured together at the ends by wing nut fasteners 82. This clamp assembly also has resiliently lined, mating sockets 84 that frictionally grip the hoses. It also has end plate segments 80*c* forming a part of the top plate 80*a* but connected thereto by hinges 80*d* to allow the end hoses to be released. The auxiliary clamp assembly 80 has suspended support on the carriage by a pair of flexible lines 86 connected between this clamp assembly and eye members 88 on the carriage. Clamp assembly 80, being supported by the lines 76** and being secured to the hoses, move freely with the carriage.

Figure 2:
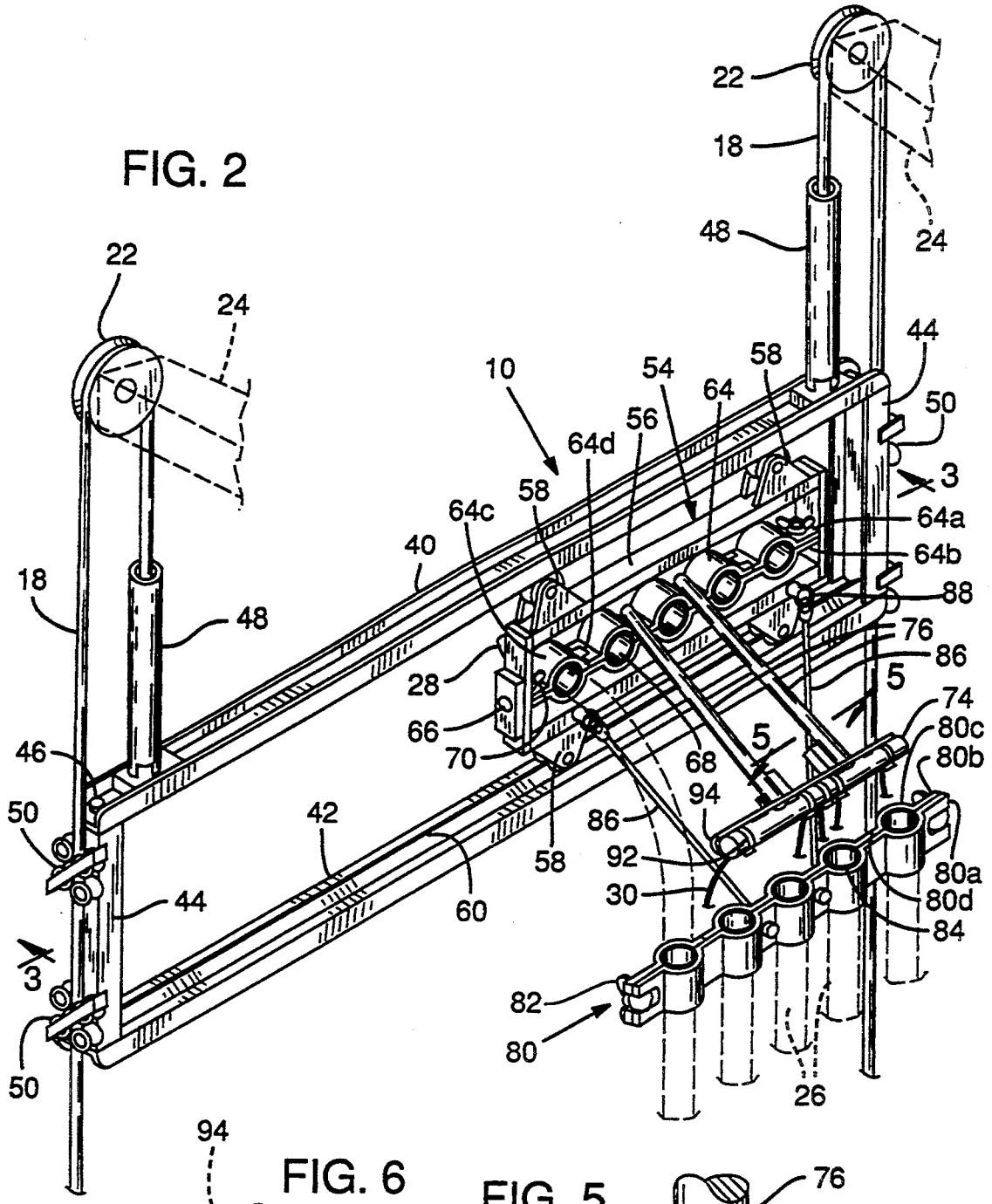
FIG. 2 is an isometric view of the invention taken from the front.
Figure 6:
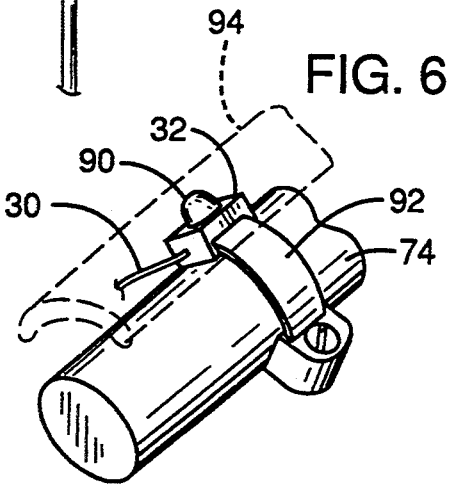
FIG. 6 is a fragmentary perspective view also detailing control mechanism of the invention.
Figure 5:
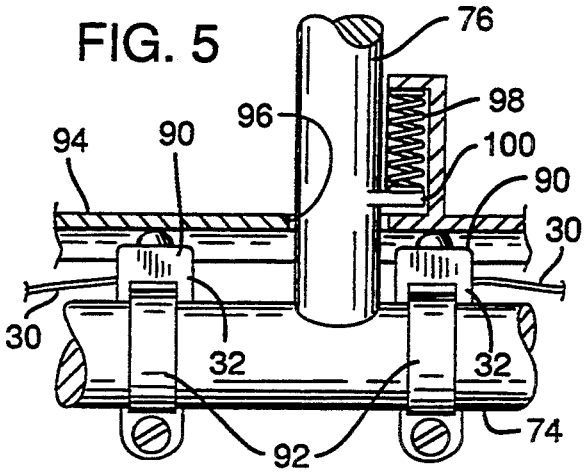
FIG. 5 is an enlarged fragmentary sectional view detailing control mechanism, this view being taken on the line 5—5 of FIG. 2.
Figure 3:
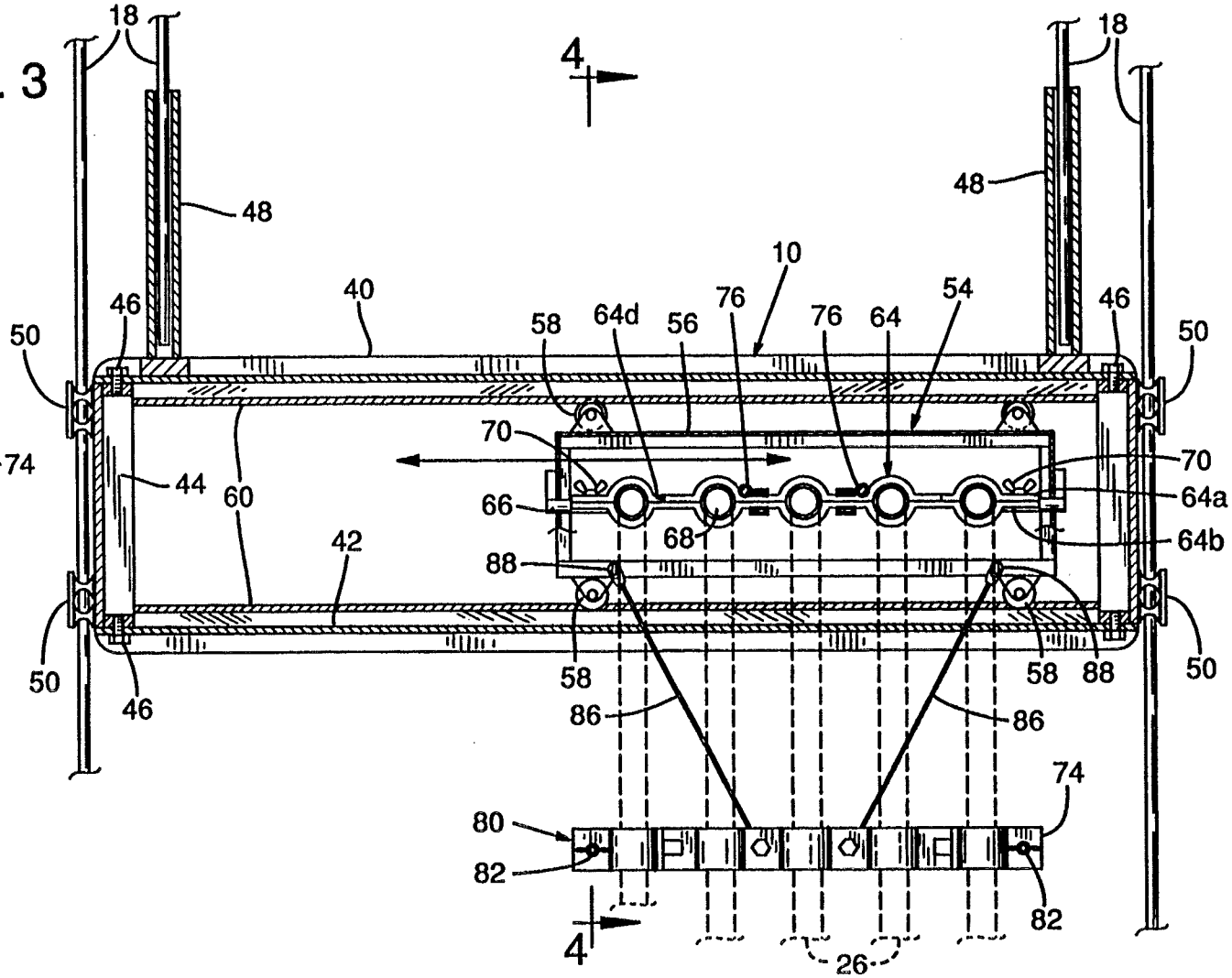
FIG. 3 is a horizontal sectional view taken on the line 3—3 of FIG. 2.
Figure 4:
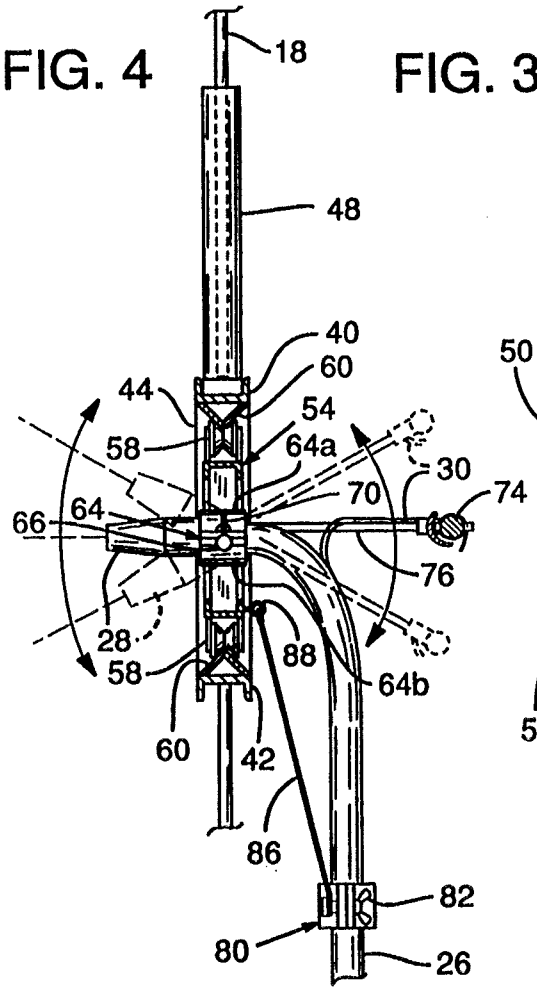
FIG. 4 is a sectional view taken on the line 4—4 of FIG. 3.

Control of conventional single hose sandblasting apparatuses is accomplished by switch means on the hose or switch means conveniently associated in some manner with the hose. With the multiple hose concept of the invention, however, the switches 32 in the electric circuit to the sandblasting apparatus are mounted on the handle 74 as shown in FIGS. 2, 5 and 6. The switches are mounted on the handle in the respective order of placement of the hoses in the clamp. The handle has a full length switch lever 94 supported thereon which when gripped with pressure by the workman engages all the switches and activates all the hoses. For the purpose of supporting the lever on the handle, the lever is slotted at 96 for guided movement on the rods 76 and is urged outwardly into a switch open position by compression springs 98 engageable between stop tabs 100 on the rods 76 and an end wall of a housing for the spring on the lever. By forcing the lever 94 toward the handle against the spring pressure, the switches are closed and the multiple sandblasting hoses activated.

Figure 7:
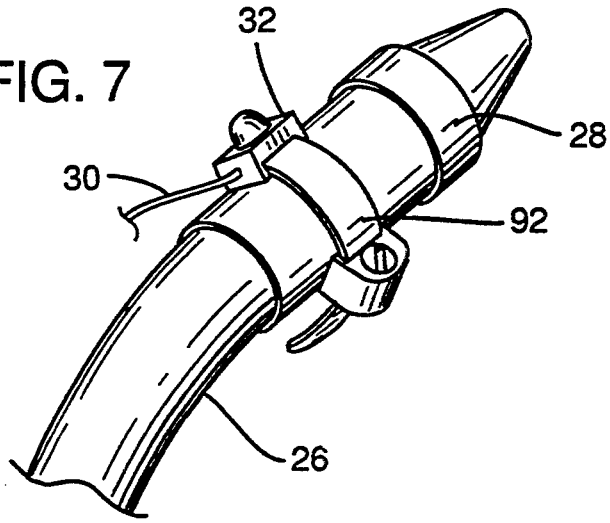
FIG. 7 is a fragmentary perspective view of a sandblasting hose and nozzle.

In the event that the workman desires to use only a single hose, one of the end hoses is removed from clamp assemblies 64 and 80 by temporarily opening the clamps by releasing a fastener 70 and the same side fastener 82. For this function of operation, the end switch 90 associated with the desired end hose on the handle 74 is detached from the handle by sliding it off the end of the handle and temporarily attaching it to the removed hose, such as to the nozzle as shown in FIG. 7. The single hose can then be used apart from the other hoses and apart from the holder.

According to the invention, a sandblast hose holder is provided that is portable and supports multiple hoses for treating large areas at once, or if desired, a single hose can be removed from the holder for treating hard to reach areas. The holder is easy to operate, namely, the handle 74 allows the workmen to readily control lateral movement of the carriage and pivotal movement of the clamp assembly 64 in an efficient treating pattern. The mass of the holder and its stabilizing engagement with the cables 18 protect the workman from recoil forces that exist at the nozzles to ease the burden on the workman. The holder frame is compact in structure for minimum construction cost and for fitting through tank openings and the like for interior work. If necessary, the frame members 40, 42 and 44 can be temporarily disassembled for moving the holder through a restricted opening.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A portable sandblasting hose holder for treating upright surfaces, comprising:

a frame having spaced top and bottom horizontal frame members and interconnecting vertical end frame members, cable connecting means on said frame capable of connection to cable lift means that can move said frame vertically and horizontally relative to a surface to be cleaned, said cable connecting means also including cable guide portions on each of the vertical end frame members for slidably receiving cables from the lift means and stabilizing the frame laterally between the cables, a carriage supported on said frame between said top and bottom horizontal frame members for adjustable movement laterally relative to said frame, a laterally extending hose clamp assembly supported on said carriage and having a plurality of sandblasting powered hoses and nozzles mounted thereon, said hose clamp assembly being supported on lateral axis horizontal pivot means in said carriage whereby said hose clamp assembly has adjustable pivotal sweeping movement relative to said carriage as well as lateral adjusting sweeping movement provided by said carriage, and operator controlled handle means projecting integrally from said hose clamp assembly for manually moving said hose clamp assembly laterally with said carriage and pivotally relative to said carriage.

2. The portable sandblasting hose holder of claim 1 wherein said hose clamp assembly includes intermediate and end hose receiving sockets, said intermediate and end hose receiving sockets having a bottom socket plate portion and a top matching top socket plate portion for securing said hoses in said sockets, said matching top socket plate portion having a releasable hinged connection therein for one of said end hose receiving sockets whereby to remove a single hose for use of a hose manually and independently of said other hoses in said hose clamp assembly.

3. The portable sandblasting hose holder of claim 2 including an auxiliary hose clamp bar spaced from said hose clamp assembly and having hose receiving sockets corresponding in number to the hose receiving sockets in said hose clamp assembly, flexible support means connected between said carriage and said auxiliary hose clamp bar for relieving said auxiliary hose clamp assembly of suspended weight of the hoses, said hose receiving socket of said auxiliary clamp bar that receives the hose from the said one of said end hose receiving sockets of said hose clamp assembly being releasable with the hose to allow the latter to be removed.

4. The portable sandblasting hose holder of claims 1 including switch means capable of operating said sandblasting powered hoses, said switch means having a structure wherein it can be mounted removably either on said operator controlled handle or on a hose nozzle depending upon whether a hose is mounted in a device or is removed for use independently of said hose holder.

* * * * *